US007111596B2

(12) United States Patent
Morin et al.

(10) Patent No.: US 7,111,596 B2
(45) Date of Patent: Sep. 26, 2006

(54) ELECTROMECHANICAL OPERATOR FOR A VALVE OF AN INTERNAL COMBUSTION ENGINE

(75) Inventors: Cédric Morin, Meudon (FR); Emmanuel Sedda, Conflans Sainte Honorine (FR); Christophe Baldi, Paris (FR); Christophe Fageon, Montrouge (FR); Raphaël Penet, Paris (FR)

(73) Assignee: Peugeot Citroen Automobiles SA, Velizy Villacoublay Cedex (FR)

( * ) Notice: Subject to any disclaimer, the term of this patent is extended or adjusted under 35 U.S.C. 154(b) by 0 days.

(21) Appl. No.: 11/046,279

(22) Filed: Jan. 27, 2005

(65) Prior Publication Data

US 2005/0199198 A1 Sep. 15, 2005

(30) Foreign Application Priority Data

Feb. 3, 2004 (FR) ..... 04 50201

(51) Int. Cl.
*F01L 1/94* (2006.01)

(52) U.S. Cl. ..... 123/90.11; 251/129.02

(58) Field of Classification Search ..... 123/90.11; 251/129.01, 129.02, 129.15, 129.16, 129.18, 251/129.19

See application file for complete search history.

(56) References Cited

U.S. PATENT DOCUMENTS 4,829,947 A * 5/1989 Lequesne ..... 123/90.11
6,334,413 B1 * 1/2002 Hattori et al. ..... 123/90.11
2003/0080306 A1 5/2003 Keiji et al.

FOREIGN PATENT DOCUMENTS

| | | |
|---|---|---|
| EP | 1 010 866 A | 6/2000 |
| EP | 1 174 595 A | 1/2002 |
| JP | 10 047 028 | 2/1998 |

* cited by examiner

*Primary Examiner*—Thomas Denion
*Assistant Examiner*—Ching Chang
(74) *Attorney, Agent, or Firm*—Fulbright & Jaworski LLP

(57) ABSTRACT

The invention relates to a valve operating apparatus comprising a ferromagnetic device connected to the valve and displaceable on a course by which at one end the valve is in the closed position and at another end it is in the open position. The displacement command is performed by means of a first and a second electromagnet and of springs so that the device will be near to the first electromagnet for the closed position and near to the second electromagnet for the open position.

Each electromagnet comprises a permanent magnet holding the device at the corresponding end of its course in the absence of current in the winding of the electromagnet. To change the valve from its open position to its closing position or vice versa, a defluxing pulse is applied to the winding of the second or of the first electromagnet opposing the effect of the permanent magnet, the change being carried out, after this pulse, by the sole action of the spring means.

7 Claims, 2 Drawing Sheets

ELECTROMECHANICAL OPERATOR FOR A VALVE OF AN INTERNAL COMBUSTION ENGINE

This application claims priorty from FR 2004/50201 filed Feb. 3, 2004 which is herein incorporated by reference in its entirety.

BACKGROUND OF THE INVENTION

The invention relates to a control apparatus of the electromechanical type for opening and closing intake and/or exhaust valves for a thermal engine, particularly an internal combustion engine.

In an internal combustion engine the valves are opened or closed at precise moments of the working cycle. In most ordinary motors, the command for opening and closing is performed mechanically according to the position of the crankshaft. In recent years, electrochanical valve controls have been developed which offer the advantage of simplifying the design of the motor and permitting the timing and the durations of the opening and closing of the valves, which can be selected at will in order to optimize the performance of the motor.

Such electromechanical valve control apparatuss generally involve a magnetic pallet or plate cooperating with two electromagnets and two springs.

For this purpose the plate is generally in one piece with the end of a rod whose other end cooperates with the stem of the valve. The rod can also be integral with the stem of the valve. One of the electromagnets is designed to attract the plate to such a position that the valve is in the closed position. In this position one spring is compressed and the other relaxed, the compressed spring being then used to push the plate toward the other position, the one in which the valve is in the open position. The command from the closed position to the open position is performed by cutting off the power from the first electromagnet and by continued supply of power to the second electromagnet. In the open position, the first spring is relaxed and the second spring is compressed. This second spring pushes the plate, upon the opening position command, toward the closing position.

To limit power consumption by the valve operator, one and/or the other of the electromagnets is of the polarized type, i.e., a permanent magnet is provided in the magnetic circuit of the one and/or the other of the electromagnets. In this case, holding the valve in an open position and/or closed position does not require any current.

SUMMARY AND OBJECTS OF THE PRESENT INVENTION

The invention aims to decrease the consumption of electric energy and to improve the reliability of operation of such a valve control apparatus. It also has the aim of increasing the possibilities for controlling a valve operator.

A valve operator according to the invention is characterized in that the closing control electromagnet and the opening control electromagnet are of the polarized type, and in that the command to switch from one position to another is performed only by a defluxing current, i.e., a current opposing the effect of locking the plate in a closed position or in an open position, the continuation of the plate movement being then controlled only by the springs.

This being the case, electric power consumption due to switching is minimized.

Furthermore, in case of malfunction of the winding of the closing control electromagnet, if the valve is in the closed position it remains in this state and, if the valve is in the open position, its closing can be commanded since, in order to change from the open position to the closed position, the winding of the opening electromagnet is acted upon because, hypothetically, it is operating correctly.

If the winding of the opening control command is broken down and if the plate is in the closed position, the current in the closing control electromagnet is held at zero so that the valve remains closed. If the winding of the opening electromagnet breaks down, and if the plate is in mid-course, a current is applied to the closing command electromagnet to set the valve in the closed position; then the current in this latter winding is brought back to zero.

Thus, in case of breakdown of a winding of one of the electromagnets, the motor can be stopped with the valve closed. It is in fact known that a motor stopped with valves closed provides a braking or locking action when the vehicle is stopped.

The windings of the two electromagnets can be in series or in parallel or independent of one another. When the windings are in parallel, if one of the coils is in open circuit (due to an accident), it does not interfere with the operation of the other winding. When the windings are in series, the short-circuiting of one winding does not prevent the operation of the other winding. The assembly of the windings in parallel is preferred over assembling them in series since the disconnection of one winding is more likely than a short circuit.

The invention relates generally to a valve operating apparatus for an internal combustion engine comprising a device of the ferromagnetic type connected to the valve and able to move along a course by which at one end of such course the valve is in the closed position and at the other end of the course, this valve is in the open position, the movement command being given by means of a first and a second electromagnet and spring means such that the device is near a first electromagnet for the closed position of the valve and near the second electromagnet for the open position of the valve, which is characterized in that the two electromagnets being of the polarized type, each with a permanent magnet enabling the device to be held at the end of its course of travel in the absence of current in the corresponding winding of this electromagnet, it comprises control means for changing the valve from its open position to its closing position or from its closing position to its opening position, having means for applying to the winding of the second electromagnet or to the winding of the first electromagnet only one defluxing pulse opposing the effect of the permanent magnet of the corresponding electromagnet, the switching being carried out, following this defluxing pulse, by the sole action of the spring means.

In one embodiment, the apparatus comprises a means for detecting the operation of the windings of the electromagnets and a safety means, in order to apply to the winding of the active electromagnet, in case of the failure of one of the windings, enabling the valve to be positioned in the closing position. In this case the safety means can comprise a means such that, in case of failure of the winding of the second electromagnet, a current can be applied to the winding of the first electromagnet permitting the device to shift toward this first electromagnet.

The invention also relates to a motor comprising an actuating apparatus of the type defined hereinabove.

BRIEF DESCRIPTION OF THE DRAWINGS

Other features and advantages of the invention will appear with the description of some of its modes of embodiment, the latter being presented by referring to the annexed drawings wherein.

DETAILED DESCRIPTION OF THE EMBODIMENTS

Figure 1:
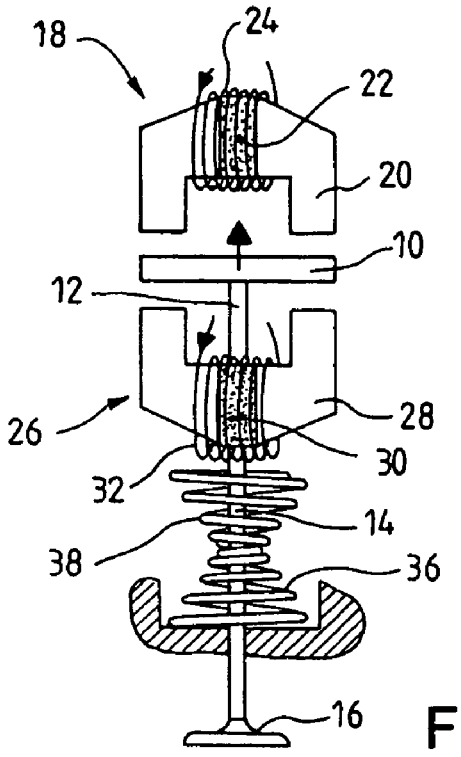
FIG. 1 is a drawing of a valve operating apparatus according to the invention.

In FIG. 1 there is shown an embodiment of an operator according to the invention, wherein, on the one hand, a closing command electromagnet of the polarized type is provided, having a magnet permitting the valve to be blocked in the closed position in the absence of current in the corresponding winding of the electromagnet and, on the other hand, an opening command electromagnet, likewise of the polarized type, the magnet of which also permits holding the valve in the opening position, in the absence of current in the corresponding winding.

Thus, in FIG. 1 there is shown a magnetic pallet or plate 10 integral with a rod 12 cooperating with a stem 14 of a valve 16.

The closing command electromagnet comprises a magnetic circuit 20, a permanent magnet 22, and a control winding 24.

The opening command electromagnet 26 comprises a magnetic circuit 28, a permanent magnet 30 and a control winding 32.

A spring 36 surrounds the valve stem 14. It is arranged such that it compresses when the valve 16 is in the open position (downward in FIG. 1) and relaxed in the case in which the valve 16 is in the closing position (upward as represented in FIG. 1).

Likewise, a spring 38 surrounds the rod 12 and is arranged such that it is compressed when the valve is in the closed position and relaxed when the valve is in the open position.

When the operator represented in FIG. 1 operates normally (without failure) the plate 10 is attracted toward the magnetic circuit 20 due to the powering of the winding 24 and to the effect of the permanent magnet 22. The current in winding 24 is zero when the valve is in the closed position since the magnet 22 suffices to hold the plate against the magnetic circuit 20. In this position the spring 36 is relaxed and the spring 38 is compressed.

To pass from the closed position to the open position, a defluxing current is provided in the winding 24 which opposes the effect of the permanent magnet 22, that is, opposes a current of a sense contrary to that which is used in order to attract the plate 10 toward the circuit 20.

Due to the effect of this defluxing current and to the effect of the spring 38, the plate 10 is directed toward the circuit 28. Then the permanent magnet 30 attracts the plate 10 without the need to energize winding 32.

The change from the opening position to the closing position is made in a similar manner by applying a defluxing current to winding 32.

In case of a breakdown of winding 24, such breakdown being able also to be detected by an absence of current in spite of an energizing command, a current called a "defluxing" current is applied to winding 32, enabling it to push the plate toward the circuit 20 and thus to order the valve 16 to be placed in the closed position. The valve 16 can then remain in this position due to the effect of the permanent magnet 22.

Thus, regardless of the inactive winding, the valve can be held in the closed position.

Figure 2A:
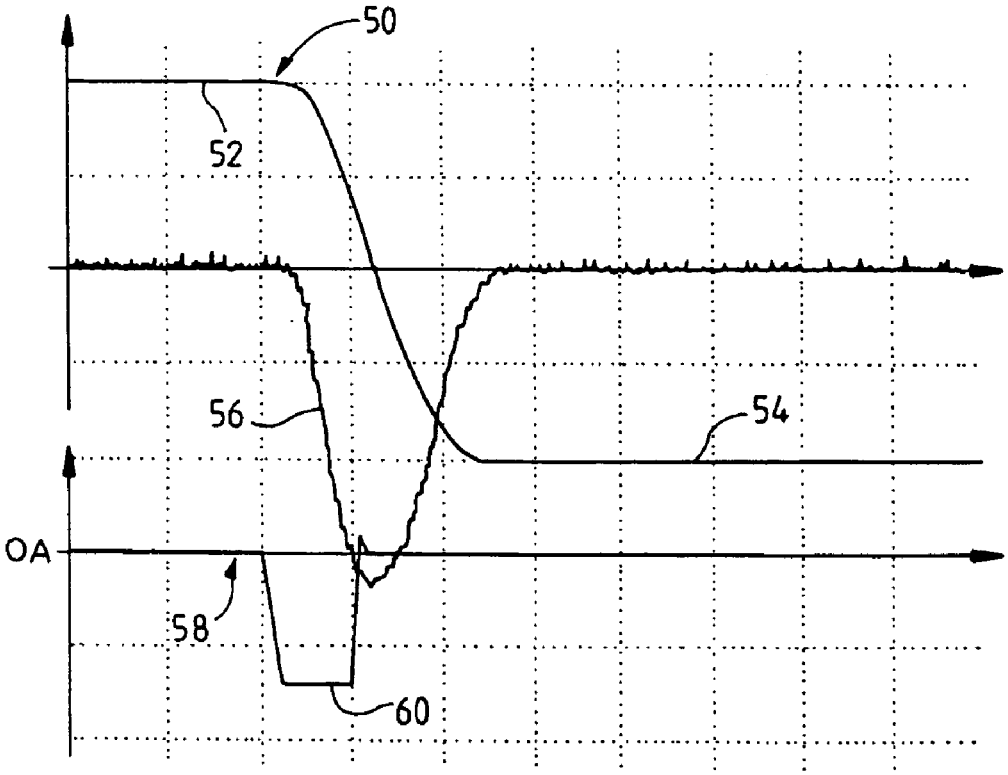
FIGS. 2*a* and 2*b* are diagrams illustrating the operation of a valve operator pursuant to FIG. 1.

In FIG. 2*a* there is shown the change from the closed position to the open position of the valve. In the diagrams of FIG. 2*a* the time is represented on the abscissae and ordinates, in the upper diagram, the position and the speed of the valve or of the plate, and in the lower diagram the intensity of the current in the winding 24.

Curve 50 represents the position of the valve. At portion 52 of this curve 50, the valve is in the closed position, and in portion 54 the valve is in the open position. Curve 56 represents the variation of the speed of the valve or of the plate. In the lower diagram, the curve 58 represents the current intensity in the winding 24. This intensity is zero save for a pulse 60 during which a defluxing current is applied. Furthermore, the current in winding 32 is kept at zero.

Figure 2B:
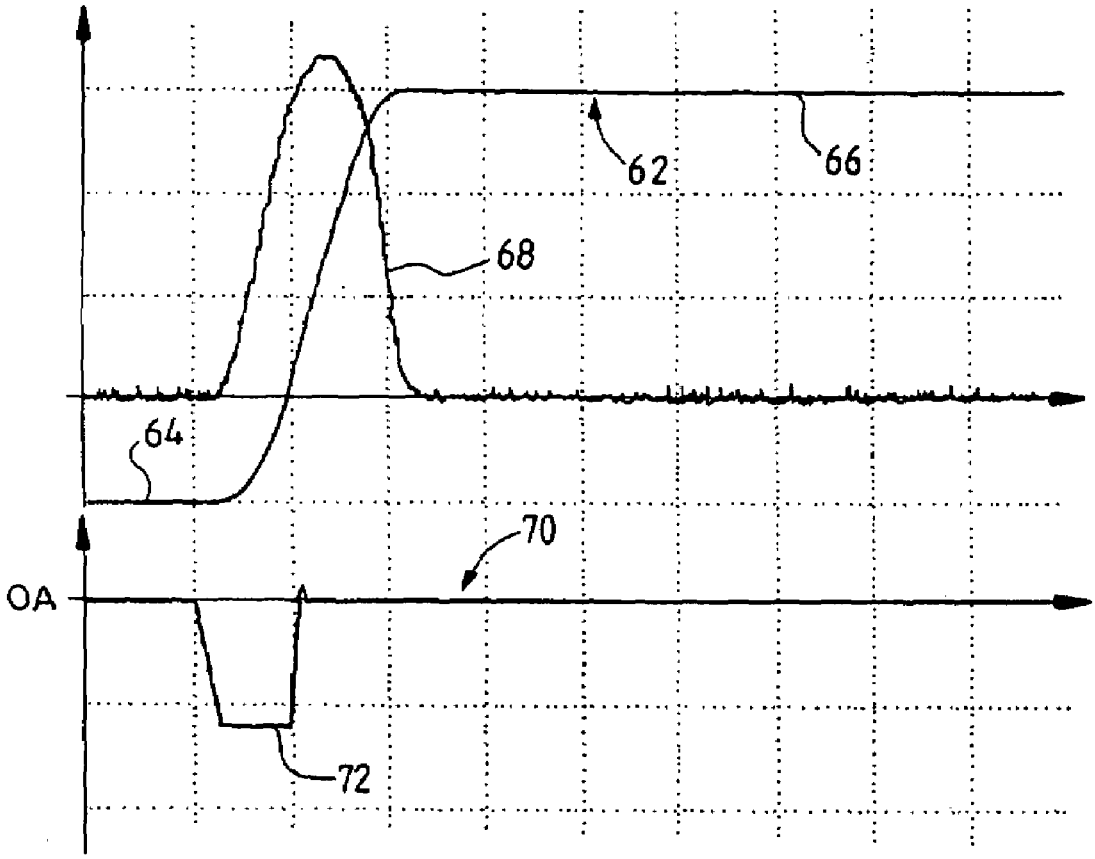

FIG. 2*b* represents the switching from the open position to the closed position of the valve. In this case to the winding 32 a defluxing current is applied which opposes holding the plate 10 against the circuit 28 and no current is applied to the winding 24.

In the diagrams of FIG. 2*b*, curve 62 represents the change of the position of the valve from the open position 64 to the closed position 66. Curve 68 represents the variation of the speed of the valve, and in the lower diagram of FIG. 2*b* the curve 70 represents the variation of the current in coil 32. The current intensity in this coil remains equal to zero except during the application of a defluxing pulse 72.

Thus, the switch from one position to another requires but a slight consumption of electric energy.

Moreover, in case of failure of winding 24, a current applied to winding 32 allows the valve to be changed to the closed position.

Regardless of what winding fails, the valve can be kept in the closed position.

What is claimed:

1. Apparatus for operating a valve of an internal combustion engine, comprising:

a first polarized type electromagnet comprising a permanent magnet and a winding;

a second polarized type electromagnet comprising a permanent magnet and a winding;

a spring; and a ferromagnetic type device connected to said valve, and displaceable by said first electromagnet, said second electromagnet and said spring to shift said valve to either an open position or a close position;

wherein said ferromagnetic device is at a first position near said first electromagnet when said valve is in said closed position and held at said first position in the absence of a current in said winding of said first electromagnet, and at a second position near said second electromagnet when said valve is in said open position and held at said second position in the absence of a current in said winding of said second electromagnet, thereby minimizing the consumption of electric energy; and wherein said ferromagnetic device and said spring is operable to shift said valve from said open position to said closed position when a defluxing current is applied to said winding of said second electromagnet to oppose the effect of said permanent magnet of said second electromagnet, and to shift said valve from said close position to said open position when said defluxing current is applied to said winding of said first electromagnet to oppose the effect of said permanent magnet of said first electromagnet.

2. Apparatus of claim 1, wherein said permanent magnet of said first electromagnet is operable to hold said ferromagnetic device at said first position in the absence of the current in said winding of said first electromagnet; and wherein said permanent magnet of said second electromagnet is operable to hold said ferromagnetic device at said second position in the absence of the current in said winding of said second electromagnet.

3. Apparatus of claim 1, further comprising:

a detection means for detecting a failure in said winding of said first electromagnet or said winding of said second electromagnet; and a safety means for applying said defluxing current to said winding of a non-failing electromagnet permitting said valve to be placed in said closed position when said detection means detects said failure.

4. Apparatus of claim 3, wherein said safety means applies said deflux current to said winding of said first electromagnet permitting said ferromagnetic device to shift towards said first position when said detection means detects a failure said winding of said second electromagnet.

5. Apparatus of claim 1, wherein said deflux current comprises one defluxing pulse.

6. A motor comprising said apparatus of claim 1.

7. Apparatus for operating a valve of an internal combustion engine, comprising:

a first polarized type electromagnet comprising a permanent magnet and a winding;

a second polarized type electromagnet comprising a permanent magnet and a winding;

a spring; and a ferromagnetic type device connected to said valve, and displaceable by said first electromagnet, said second electromagnet and said spring to shift said valve to either an open position or a close position;

wherein said ferromagnetic device is at a first position near said first electromagnet when said valve is in said closed position and held at said first position when said winding of said first electromagnet has zero current, and at a second position near said second electromagnet when said valve is in said open position and held at said second position when said winding of said second electromagnet has zero current, thereby minimizing the consumption of electric energy; and wherein said ferromagnetic device and said spring is operable to shift said valve from said open position to said closed position when a defluxing current is applied to said winding of said second electromagnet to oppose the effect of said permanent magnet of said second electromagnet, and to shift said valve from said close position to said open position when said defluxing current is applied to said winding of said first electromagnet to oppose the effect of said permanent magnet of said first electromagnet.

* * * * *